US006966697B2

(12) United States Patent
Patridge et al.

(10) Patent No.: US 6,966,697 B2
(45) Date of Patent: Nov. 22, 2005

(54) TRASH BAGS WITH NARROWING SEALS TO FACILITATE GRIPPING

(75) Inventors: Clifford H. Patridge, Newark, NY (US); William P. Belias, Pittsford, NY (US); John H. Menendez, Fairport, NY (US); Eduard Kraminker, Rochester, NY (US)

(73) Assignee: Pactiv Corporation, Lake Forest, IL (US)

( * ) Notice: Subject to any disclaimer, the term of this patent is extended or adjusted under 35 U.S.C. 154(b) by 0 days.

(21) Appl. No.: 10/082,011

(22) Filed: Feb. 22, 2002

(65) Prior Publication Data

US 2003/0161554 A1 Aug. 28, 2003

(51) Int. Cl.[7] ..... B65D 30/10
(52) U.S. Cl. ..... 383/107; 383/33; 220/495.11
(58) Field of Search ..... 383/33, 107, 36, 383/903, 907; 220/495.11

(56) References Cited

U.S. PATENT DOCUMENTS

| | | | | |
|---|---|---|---|---|
| 611,498 | A | | 9/1898 | Lyon |
| 1,458,640 | A | | 6/1923 | Chase |
| 1,911,724 | A | | 5/1933 | Stein |
| 1,941,871 | A | | 1/1934 | Struve |
| 2,104,686 | A | | 1/1938 | Wood |
| 2,298,419 | A | | 10/1942 | Salfisberg |
| 2,429,538 | A | | 10/1947 | Wood |
| 2,457,918 | A | | 1/1949 | Pierce |
| 2,932,575 | A | | 4/1960 | Scion et al. |
| 2,998,340 | A | | 8/1961 | Conway et al. |
| 3,029,853 | A | | 4/1962 | Piazze |
| 3,142,437 | A | | 7/1964 | Grant et al. |
| 3,172,796 | A | * | 3/1965 | Heinz ..... 156/269 |
| 3,217,971 | A | | 11/1965 | Shvetz |
| 3,262,629 | A | | 7/1966 | Murphy et al. |
| 3,357,152 | A | | 12/1967 | Geigel |
| 3,372,857 | A | | 3/1968 | Brayla |
| 3,434,652 | A | | 3/1969 | Shore |
| 3,485,437 | A | | 12/1969 | Gruentzel et al. |
| 3,774,838 | A | | 11/1973 | Christie |
| 3,939,972 | A | | 2/1976 | Mayworm |
| 3,969,995 | A | | 7/1976 | Krueger et al. |
| 3,987,959 | A | | 10/1976 | Deards et al. |
| 3,991,961 | A | | 11/1976 | Platzer, Jr. |
| 4,171,764 | A | * | 10/1979 | Schonbach et al. ..... 383/108 |
| 4,269,247 | A | | 5/1981 | Omdal |
| 4,478,351 | A | | 10/1984 | Homma |
| 4,503,561 | A | | 3/1985 | Bruno |
| 4,509,570 | A | | 4/1985 | Eby et al. |
| 4,558,801 | A | | 12/1985 | Vilutis |
| D285,412 | S | * | 9/1986 | Harwell, Jr. ..... D9/345 |
| 4,611,350 | A | | 9/1986 | Kaczerwaski |
| 4,686,814 | A | * | 8/1987 | Yanase ..... 53/459 |

(Continued)

FOREIGN PATENT DOCUMENTS

| | | |
|---|---|---|
| BE | 862018 | 4/1978 |

(Continued)

*Primary Examiner*—Jes F. Pascua
(74) *Attorney, Agent, or Firm*—Winston & Strawn LLP

(57) ABSTRACT

A polymeric film bag having first and second panels that are joined to each other along a pair of opposing sides and a bottom bridging the opposing sides. Each of the first and second panels have an original width. Extending inwardly from near or at one of the pair of opposing sides is a first narrowing seal. The first narrowing seal seals the first and second panels together such that a second width of the first and second panels is created that is smaller than the original widths of the first and second panels.

13 Claims, 4 Drawing Sheets

U.S. PATENT DOCUMENTS

| | | | | |
|---|---|---|---|---|
| 4,747,701 | A | | 5/1988 | Perkins |
| 4,759,642 | A | * | 7/1988 | Van Erden et al. ..... 383/210.1 |
| 4,765,579 | A | | 8/1988 | Robbins, III et al. |
| 4,829,741 | A | * | 5/1989 | Langen ..... 53/122 |
| 4,842,420 | A | | 6/1989 | DiBiasi et al. |
| 4,859,082 | A | | 8/1989 | Llorens et al. |
| 4,919,546 | A | | 4/1990 | Imazeki et al. |
| 4,953,704 | A | | 9/1990 | Cortese |
| 5,018,646 | A | * | 5/1991 | Billman et al. ..... 222/107 |
| 5,059,035 | A | | 10/1991 | Kristensen |
| 5,120,138 | A | | 6/1992 | Midgley et al. |
| 5,133,607 | A | | 7/1992 | Bonke |
| 5,135,785 | A | | 8/1992 | Millon |
| 5,205,650 | A | | 4/1993 | Rasmussen |
| 5,425,468 | A | | 6/1995 | Birkel et al. |
| 5,492,240 | A | | 2/1996 | Vilutis |
| 5,720,557 | A | * | 2/1998 | Simonsen ..... 383/61.2 |
| 5,944,251 | A | * | 8/1999 | LaFleur ..... 229/117.35 |
| 5,980,109 | A | * | 11/1999 | Wan ..... 383/77 |
| 6,003,717 | A | | 12/1999 | Long |
| 6,029,844 | A | | 2/2000 | Brady |
| 6,092,933 | A | | 7/2000 | Treu |
| 6,220,753 | B1 | | 4/2001 | Metzger |
| 6,257,764 | B1 | | 7/2001 | Lantz |
| 6,398,411 | B2 | | 6/2002 | Metzger |

FOREIGN PATENT DOCUMENTS

| | | |
|---|---|---|
| DE | P.A. 258 854 | 5/1968 |
| DE | 1 922 573 | 3/1971 |
| DE | 40 37 434 A1 | 5/1992 |
| EP | 0 372 173 A2 | 6/1990 |
| EP | 0 537 108 A2 | 4/1993 |
| EP | 0 603 963 A2 | 6/1994 |
| EP | 0 603 963 A3 | 6/1994 |
| EP | 0 866 001 A1 | 9/1998 |
| FR | 1137074 | 5/1957 |
| FR | 2 469 355 | 5/1981 |
| FR | 2 696 992 | 4/1994 |
| GB | 1 465 695 | 2/1977 |
| JP | 39-5467 | 3/1939 |
| JP | 64-64901 | 3/1989 |
| JP | 03242320 | 8/1991 |
| JP | 08257228 | 9/1996 |
| JP | 9-2602 | 1/1997 |
| JP | 09017759 | 1/1997 |
| JP | 09237591 | 7/1997 |
| JP | 09257967 | 9/1997 |
| JP | 09322442 | 11/1997 |
| JP | 3051031 | 5/1998 |
| JP | 11-227901 | 8/1999 |
| WO | WO 98/58851 | 12/1998 |

* cited by examiner

TRASH BAGS WITH NARROWING SEALS TO FACILITATE GRIPPING

FIELD OF THE INVENTION

The present invention relates generally to polymeric bags and, more particularly, to polymeric bags having a narrowing seal feature that enables the bag to fit to upper portions of various size containers when used as a liner.

BACKGROUND OF THE INVENTION

Sealable polymeric packages, such as trash bags, are a common household item. Some bags come to the consumer in the form of a roll of interconnected bags or as pre-separated bags housed in a dispensing box. When the bags are provided in the form of a roll, one end of the bag, the bottom, is thermally sealed closed and connected to its neighboring bag along a perforated line; the other end of the bag, the open top end, is attached to its neighboring bag solely along another perforated line. In another type of bag, a polymeric sheet is folded, creating the bottom of the bag, and the sides are sealed. When the bags are pre-separated, neighboring bags are generally overlapped or interweaved in such a manner that removal of one bag from the dispensing box draws the neighboring bag toward an opening in the box.

The bags are often sized and sold to correspond to a particular size container or trashcan. Some trash bags are designed so that a user may fold a top end of the bag over the top of the trashcan, thus lining the can with the bag. With this design, a piece of trash disposed in the trashcan will fall in the bag. If the top of the trash bag does not snugly fit the top of the trashcan, problems can arise. For example, if the perimeter of the top of the trash bag is either too small or too big, the bag may slip and fall into the trashcan. This may result in the trash missing the bag, which is undesirable and may cause customer dissatisfaction during removal of the trash from the trashcan. Therefore, it is desirable that the top of the trash bag fit snugly over the top of the trashcan.

In an attempt to address this problem, trash bags are often marked by their size and/or which size trashcan the bag is intended to fit. Most bags are labeled by the lay flat (half the perimeter) size, the diameter size, or the volume of the trashcan. Many consumers do not, however, know the lay flat, diameter, or volume size of the trashcan for which they are purchasing bags. Thus, in these situations, it is not helpful to list this information on the trash bag packages. To alleviate this problem, some bags are sold with an identification as to the type of trashcan the bag fits (i.e., tall kitchen bags). There are different sizes, however, even for "tall kitchen" trashcans. Some tall kitchen trashcans have a perimeter of 48 inches, while others may only have a perimeter of 41 or 42 inches. Thus, some consumers may still purchase the wrong size trash bags even when focused on purchasing tall kitchen bags.

Some bags that address the issue of bag slippage into the trashcan add cost in both processing and materials. For example, some bags utilize elastic drawstrings to alleviate this problem. This requires that the bag must have a drawstring, however, which is more expensive to add to the bag.

Therefore, there is a need for a trash bag that can be adjustable to fit a variety of containers or trashcans while overcoming the above-described problems.

SUMMARY OF THE INVENTION

The present invention is a polymeric film bag that includes a first panel and a second panel that are joined to each other along a pair of opposing sides and a bottom bridging the opposing sides. The first and second panels each have an original width. At least a first narrowing seal is also included in the bag and extends inwardly from near or at one of the pair of opposing sides. The first narrowing seal seals the first panel to the second panel such that a second width of the first and second panels is created that is smaller than the original widths of the first and second panels.

The above summary of the present invention is not intended to represent each embodiment or every aspect of the present invention. This is the purpose of the Figures and the detailed description which follow.

BRIEF DESCRIPTION OF THE DRAWINGS

The foregoing and other advantages of the invention will become apparent upon reading the following detailed description and upon reference to the drawings.

Figure 1:
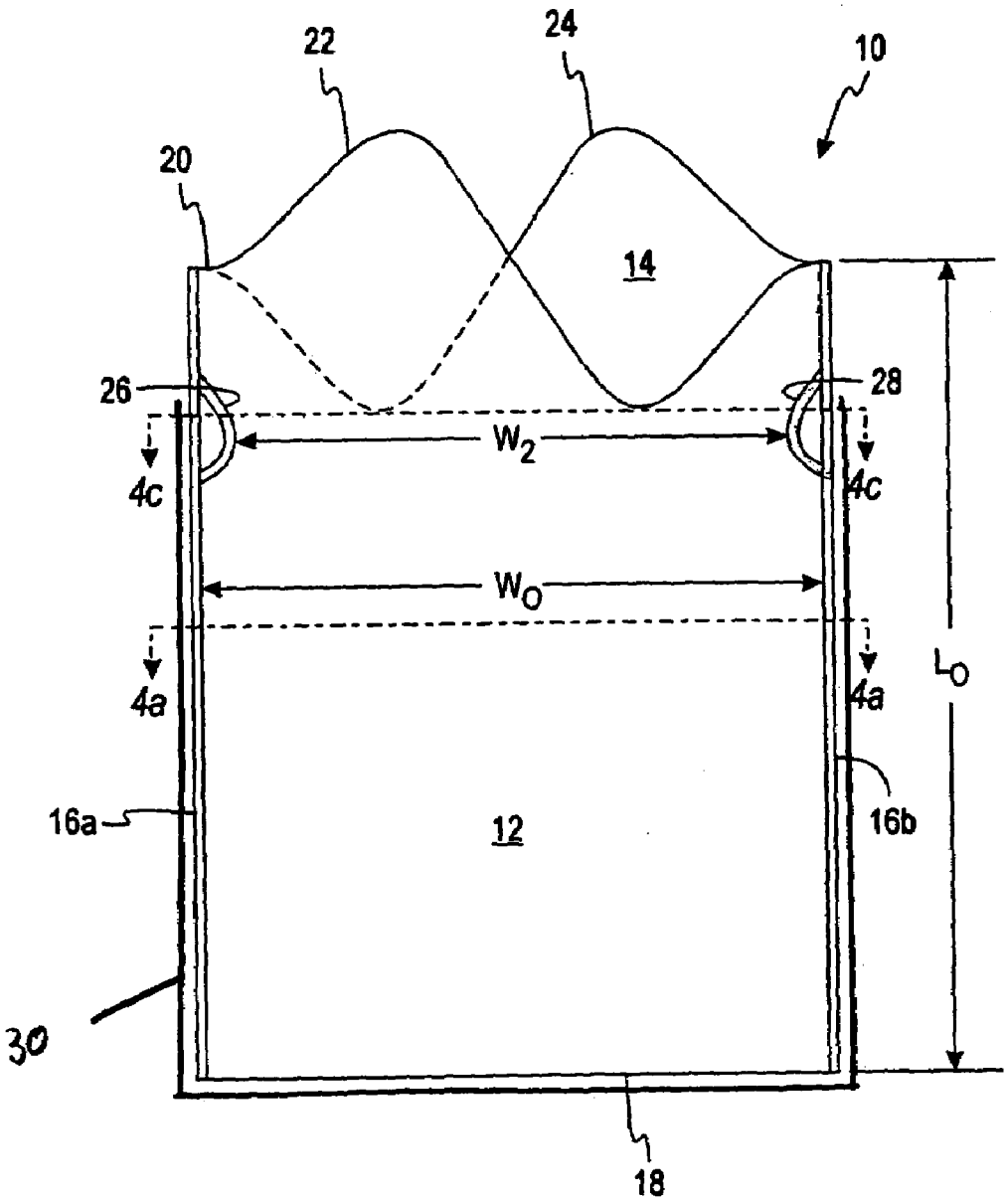
FIG. 1 is a side view of a polymeric bag according to one embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATIVE EMBODIMENTS

Figure 2:
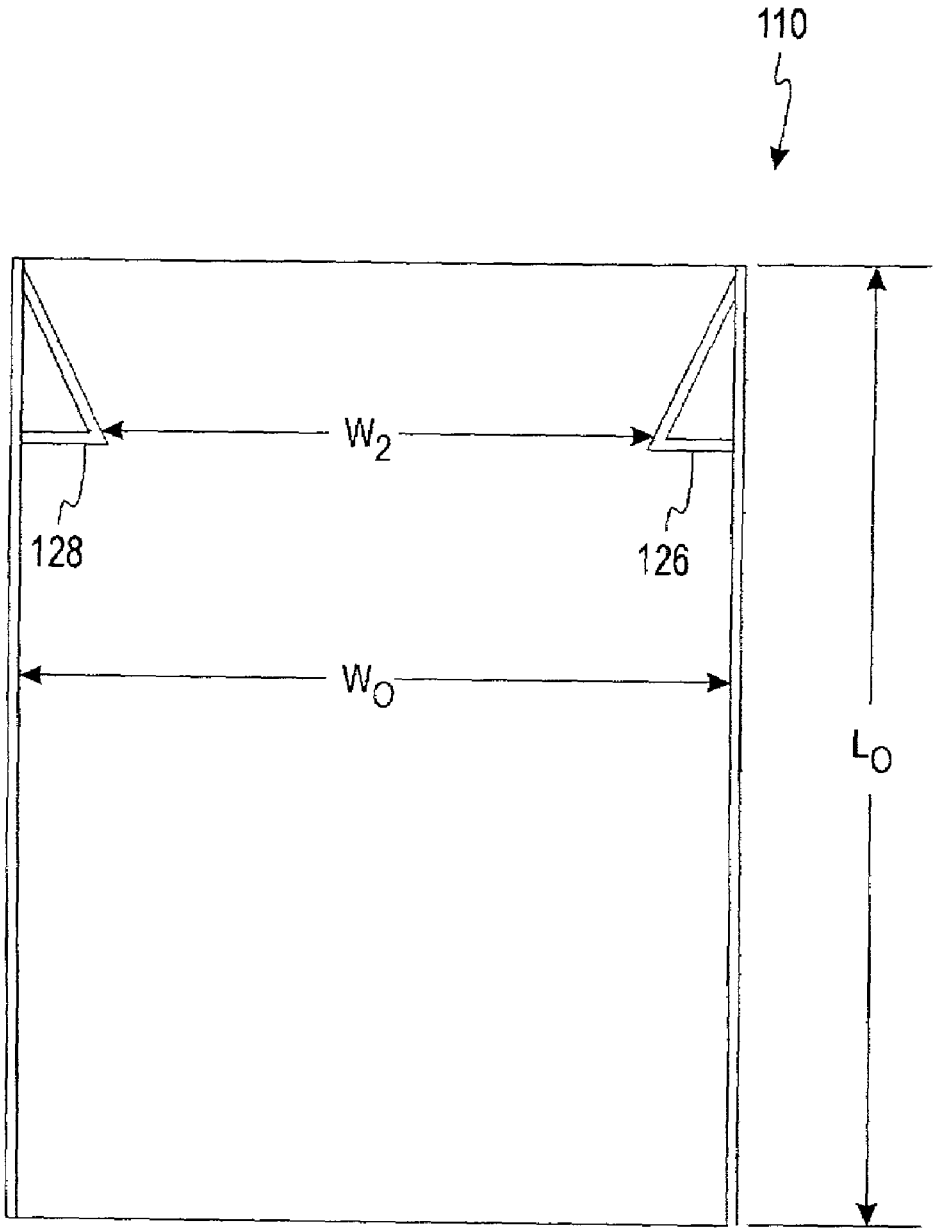
FIG. 2 is a side view of a polymeric bag according to another embodiment of the present invention.

FIG. 1 illustrates a polymeric bag 10 according to one embodiment of the present invention. The polymeric bag 10 may be used in combination with a trashcan or container. The container includes a fixed shape frame and a bag engaging periphery. The polymeric bag 10 lines the trashcan or container, and a top portion of the bag engages the periphery of the trashcan or container in order to hold the bag in place. The polymeric bag 10 has a first panel 12 and a second panel 14. The first and second panels 12, 14 each have an original width and an original length. In this embodiment, the original length $L_0$ of the first panel 12 is about the same as the original length $L_0$ of the second panel 14. Similarly, the original width $W_0$ of the first panel 12 is about the same as the original width $W_0$ of the second panel 14. The first and second panels 12, 14 are joined to each other along a pair of opposing sides 16*a*, 16*b* and a bottom 18 bridging the opposing sides 16*a*, 16*b*. The first and second panels 12, 14 are open along a top end 20 formed opposite the bottom 18. The first and second panels 12, 14 may each include an optional tying flap 22, 24 at the top end 20, as shown in FIG. 1. The tying flaps 22, 24 may be used to tie the top end 20 closed after use and/or to lift the bag 10 out of the trashcan or container after use. The top end 20 of the bag 10 may also be flat (i.e., generally perpendicular to the sides), as depicted in FIG. 2. It is contemplated that the top end may be configured differently than depicted in FIGS. 1 and 2.

The first and second panels 12, 14 can be composed of a wide range of polymeric materials that have enough elasticity to expand to the original size of the bag, such as linear low density polyethylenes (LLDPE), low density polyethylenes (LDPE), high density polyethylenes (HDPE), polyesters, polystyrenes, or combinations of these polymers. Other thermoplastics may also be used to form the first and second panels 12, 14. In addition, the first and second panels 12, 14 may be composed of coextruded films having two or more layers. Each of the first and second panels 12, 14 preferably has a thickness ranging from about 0.4 mil to about 2 mils.

The first and second panels 12, 14 may be formed of one polymeric sheet of film that is folded to create the bottom 18, a first opposing side 16*a*, or the second opposing side 16*b*. The non-folded bottom 18 and/or opposing sides 16*a*, 16*b* would then be sealed, leaving the top end 20 open.

Alternatively, the first and second panels 12, 14 may be formed from two separate sheets of polymeric film that are sealed together at both of the pair of opposing sides 16*a*, 16*b* and the bottom 18. The top end 20 remains open to create the bag 10.

The first and second panels 12, 14 also include a first narrowing seal 26 and a second narrowing seal 28. The first and second narrowing seals 26, 28 seal the first and second panels 12, 14 together. The first and second narrowing seals 26, 28 may be formed by heat sealing the first and second panels 12, 14 together. Alternatively, the first and second narrowing seals 26, 28 may be formed by using an adhesive to adhere the first and second panels 12, 14 together. It is contemplated that the narrowing seals 26, 28 may be formed from other methods, such as ultrasonics.

In the embodiment shown in FIG. 1, the narrowing seals 26, 28 are located below the top end 20 at or near the respective sides 16*a*, 16*b*. The narrowing seals 26, 28 initially extend inwardly from at or near the respective sides 16*a*, 16*b*, and extend generally downwardly before returning to or near the respective sides 16*a*, 16*b*. In this embodiment, the narrowing seals 26, 28 are generally arcuate in shape, however, other shapes may also be utilized. For example, bag 110 shown in FIG. 2 has narrowing seals 126, 128 that are formed in a triangular configuration. Other shapes are contemplated for the narrowing seals, such as polygonal shapes.

Returning now to FIG. 1, the narrowing seals 26, 28 create a second width $W_2$ that is less than the original widths $W_0$ of the first and second panels 12, 14. The second width $W_2$ enables the bag 10 to be used with containers or trashcans of multiple sizes. The top edges 20, 22 have original widths $W_0$, and may be placed over the tops of one size trashcan. At the narrowing seals 26, 28, however, the bag 10 has the second width $W_2$. The user may insert the bag 10 into a smaller trashcan, and fold the top end 20 down to the narrowing seals 26, 28. Since the narrowing seals 26, 28 create a smaller width $W_2$, the bag 10 can fit snugly over the top of a smaller trashcan. Thus, the present embodiment allows a single bag 10 to be used with multiple size trashcans. In one embodiment, the width $W_0$ of the first and second panels 12, 14 is about 24 inches and the width $W_2$ between the narrowing seals is about 21 inches. It is also contemplated that the original width $W_0$ and the second width may have other sizes to fit other size trashcans, such as outdoor trashcans. Although two narrowing seals are shown in these drawings, in some embodiments, there may only be one narrowing seal used. The narrowing seal may be located on either side of the panels and operate the same as two narrowing seals. The one narrowing seal creates the second width $W_2$ that is less than the original width $W_0$.

Thus, in these embodiments, the bag works with trashcans or containers of two different sizes, enabling consumers to purchase the bag without knowing the exact size of their container. Also, the step of adding the narrowing seals may be done with little or no increased processing time or cost, since the narrowing seals may be formed at the same time as other seals using the same machinery.

Figure 3:
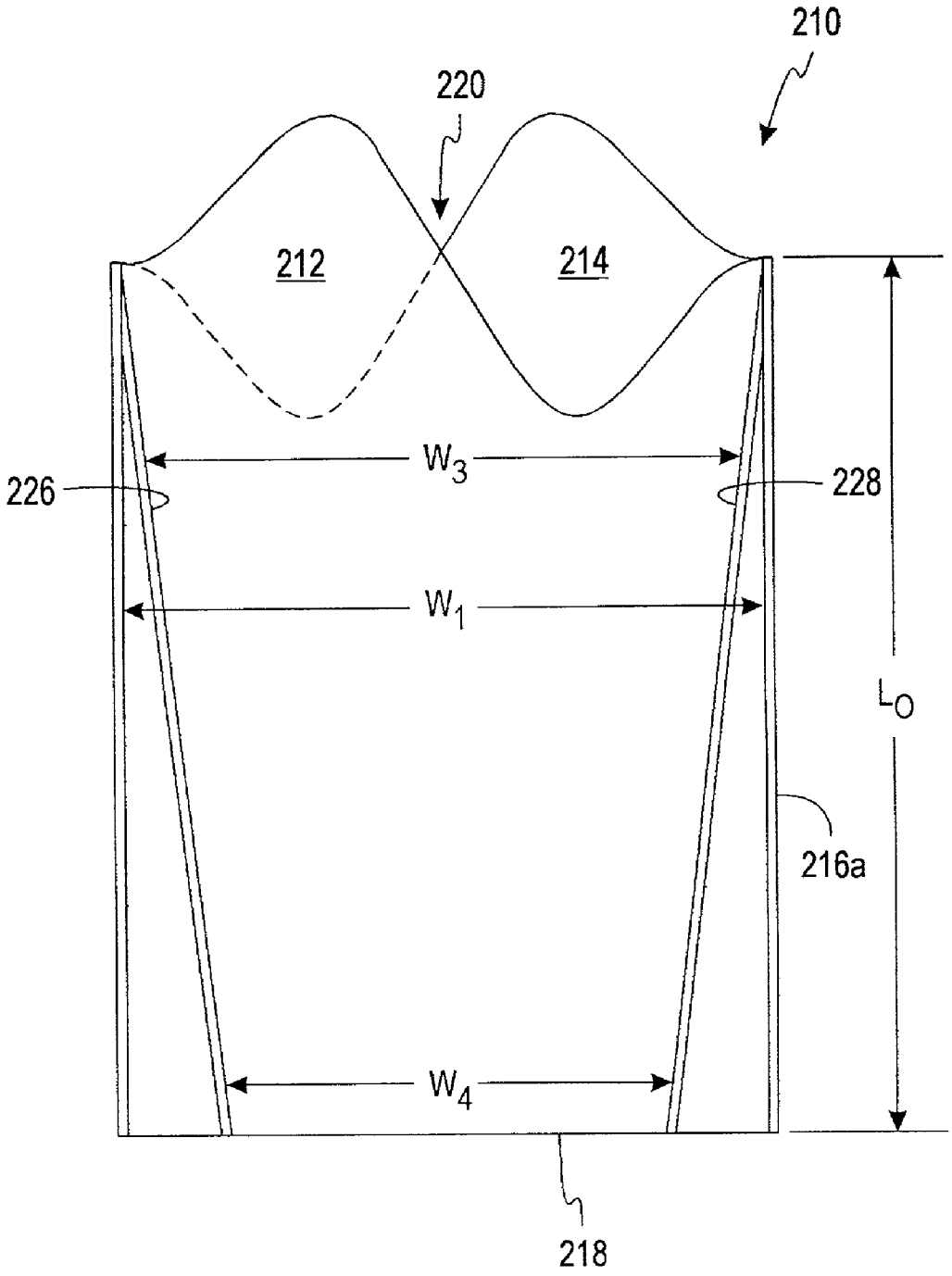
FIG. 3 is a side view of a polymeric bag according to another embodiment of the present invention.

Turning now to FIG. 3, another embodiment of a trash bag 210 according to the present invention is illustrated. In this embodiment, narrowing seals 226, 228 extend toward a bottom 218 of the bag 210. The narrowing seals 226, 228 create a third width $W_3$ and a fourth width $W_4$ that are both less than an original width $W_1$ of first and second panels 212, 214 of the bag 210. The first and second panels 212, 214 include opposing side edges 216*a*, 216*b*, the bottom 218, and an open top end 220. The narrowing seals 226, 228 are formed to seal the first and second panels 212, 214 together, as in the embodiment discussed above. The narrowing seals 226, 228 may be joined together by hot sealing or by utilizing an adhesive.

In this embodiment, the narrowing seals 226, 228 start at or near the respective sides 216*a*, 216*b* and extend generally downwardly toward the bottom 218. In some embodiments, the narrowing seals 226, 228 extend generally parallel to the sides 216*a*, 216*b*, keeping the same width throughout. In this embodiment, the third width $W_3$ is approximately equal to the fourth width $W_4$. In the embodiment shown in FIG. 3, the narrowing seals 226, 228 extend inwardly and downwardly. Thus, the third width $W_3$ is greater than the fourth width $W_4$, and the bag 210 may be used with a variety of trashcan sizes. Also, the step of adding the narrowing seals 226, 228 may be done with little or no increased processing time or cost since the narrowing seals may be formed at the same time as other seals using the same machinery.

In some embodiments, the original widths $W_1$ of the first and second panels 212, 214 is approximately 24 inches and the third width $W_3$ is about 21 inches and decreases until the four width $W_4$ is about 20 inches, although other sizes are contemplated.

Although these embodiments have been described with two narrowing seals, in some embodiments, there is only one narrowing seal. The single narrowing seal operates the same as the two narrowing seals, and creates third and fourth widths $W_3$, $W_4$ that are less than the original width $W_1$ of the panels.

Figure 4A:
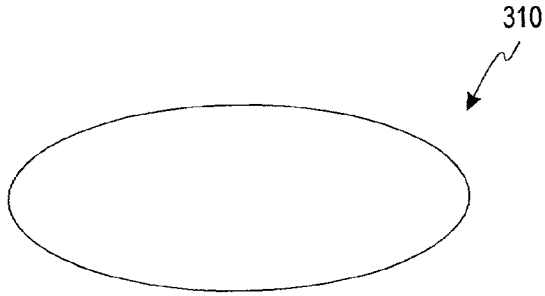
FIG. 4*a* is a cross-sectional view taken along the line 4*a*—4*a* of FIG. 1 when the bag is in an open position.
Figure 4B:
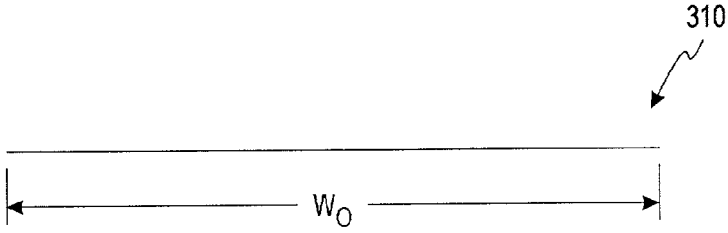
FIG. 4*b* is a line cross-sectional view taken along the line 4*a*—4*a* of FIG. 1 when the bag is in a folded position.
Figure 4C:
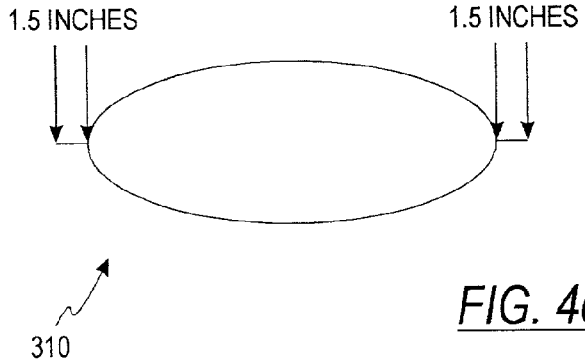
FIG. 4*c* is a cross-sectional view taken along the line 4*c*—4*c* of FIG. 1 when the bag is in an open position.
Figure 4D:
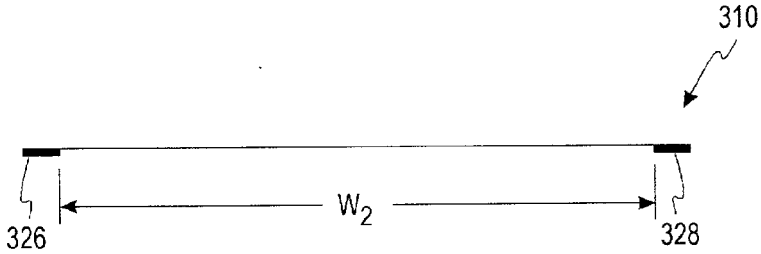
FIG. 4*d* is a line cross-sectional view taken along the line 4*c*—4*c* of FIG. 1 when the bag is in a folded position.

Turning to FIGS. 4*a*–4*d*, the change in diameter in a bag 310 utilizing narrowing seals 326, 328 is illustrated. FIGS. 4*a* and 4*b* show a cross-sectional view of a top end 320 of the bag 310 before the start of the narrowing seals 326, 328. FIG. 4*a* depicts the bag 310 in an open position, having a perimeter of about 48 inches. FIG. 4*b* illustrates a flat width of the bag 310, which is about 24 inches. In FIGS. 4*c* and 4*d*, cross-sectional views of the bag 310 at the narrowing seals 326, 328 are shown. At this point along the length of the bag 310, the bag 310 has a perimeter of about 42 inches and a flat width of about 21 inches. Thus, as can be clearly seen, the bag 310 can be used with at least two different size trashcans, which makes the bags easier to use and may also decrease customer dissatisfaction. Furthermore, unlike some prior attempts to solve this problem, the embodiments of the present invention do not substantially increase the material or manufacturing costs or the time in manufacturing the bag.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A polymeric bag and container in combination, comprising:

a container having a bag engaging periphery; and a bag including a first panel and a second panel each having an original width and a length, the first and second panels joined along a pair of opposing sides and a closed bottom defining an open top between the opposing sides and opposite the closed bottom, a first narrowing seal sealing the first panel to the second panel; and a second narrowing seal sealing the first panel to the second panel, the first and second narrowing seals disposed such that a second width of the first and second panels is created that is smaller than the original widths of the first and second panels, the first and second narrowing seals initially extending inwardly from said bag sides and extending generally downwardly before extending back to said bag sides, the first narrowing seal and the second narrowing seal each being disposed closer in proximity to the top than to the bottom, the second width adapted to grip the bag engaging periphery of the container.

2. The bag combination of claim 1, wherein at least one of the first narrowing seal and the second narrowing seal extends toward the bottom in a direction generally parallel to the pair of opposing sides.

3. The bag combination of claim 1, wherein at least one of the first narrowing seal and the second narrowing seal extends toward the bottom, such that the second width becomes smaller toward the bottom.

4. The bag combination of claim 3, wherein the second width is about 21 inches and gradually decreases to about 20 inches toward the bottom edges.

5. The bag combination of claim 1, wherein at least one of the first narrowing seal and the second narrowing seal is arcuate or triangular in shape.

6. The bag combination of claim 1, wherein at least one of the first narrowing seal and the second narrowing seal is formed by heat sealing the first and second panels.

7. The bag combination of claim 1, wherein at least one of the first narrowing seal and the second narrowing seal is formed by adhering the first and second panels.

8. The bag combination of claim 1, wherein the first and second panels are formed from an integral folded single sheet of polymer.

9. The bag combination of claim 1, wherein the bottom of the bag is formed by folding the first and second panels.

10. The bag combination of claim 1, wherein one of the pair of opposing sides of the bag is formed by folding the first and second panels.

11. The bag combination of claim 1, wherein the first and second panels are formed from two separate polymeric sheets.

12. The bag of claim 1, wherein the bottom is a straight bottom.

13. The polymeric bag and container of claim 1, wherein the first and second panels further define at least two tying flaps proximate the open top.

* * * * *